US006175374B1

(12) United States Patent
Broddin et al.

(10) Patent No.: US 6,175,374 B1
(45) Date of Patent: Jan. 16, 2001

(54) METHOD FOR STABLE ELECTRO (STATO) GRAPHIC REPRODUCTION OF A CONTINUOUS TONE IMAGE

(75) Inventors: Dirk Broddin, Edegem; Serge Tavernier, Lint, both of (BE)

(73) Assignee: Agfa-Gevaert, Mortsel (BE)

( * ) Notice: Under 35 U.S.C. 154(b), the term of this patent shall be extended for 0 days.

(21) Appl. No.: 09/047,263

(22) Filed: Mar. 24, 1998

Related U.S. Application Data

(63) Continuation-in-part of application No. 08/724,065, filed on Sep. 30, 1996, now Pat. No. 5,825,504.
(60) Provisional application No. 60/008,593, filed on Dec. 13, 1995.

(30) Foreign Application Priority Data

Oct. 13, 1995 (EP) ..... 95202768

(51) Int. Cl.[7] ..... B41J 2/41
(52) U.S. Cl. ..... 347/112
(58) Field of Search ..... 347/111, 112, 347/114, 15, 43; 399/3

(56) References Cited

U.S. PATENT DOCUMENTS 4,860,026 * 8/1989 Matsumoto et al. ..... 347/15
5,825,504 * 10/1998 Broddin et al. ..... 358/300

FOREIGN PATENT DOCUMENTS

4338922 * 5/1994 (DE) .
0606022 * 7/1994 (EP) .
0629927 * 12/1994 (EP) .
58-162970 * 9/1983 (JP) .

* cited by examiner

*Primary Examiner*—Huan Tran
(74) *Attorney, Agent, or Firm*—Baker Botts L.L.P.

(57) ABSTRACT

An apparatus is provided for reproducing a continuous tone image by imagewise application of toner particles to a substrate comprising:

means for partitioning a surface of the substrate in a plurality of disjunctive microdots;

means for applying to at least one microdot at least two types of toner, having substantially the same chromaticity.

Preferentially, for each toner type a large majority of microdots within a region comprising adjacent microdots, is supplied with either a high or low amount of toner, whereas the other microdots are supplied with a medium amount of toner, and more preferentially for at least one toner type the region comprises at least one microdot supplied with a high, another with a low and another with a medium amount of said toner.

In a preferred embodiment the minimum number (N) of types of toner particles used in the apparatus depends on the volume average size of the toner particles used.

18 Claims, 7 Drawing Sheets

METHOD FOR STABLE ELECTRO (STATO) GRAPHIC REPRODUCTION OF A CONTINUOUS TONE IMAGE

This application is a continuation-in-part of U.S. application Ser. No. 08/724,065, filed on Sep. 30, 1996, now U.S. Pat. No. 5,825,504.

The application claims the benefit of the U.S. Provisional Application Ser. No. 60/008,593 filed Dec. 13, 1995.

FIELD OF THE INVENTION

The invention relates an apparatus for reproducing continuous tone images. In particular, but not exclusively to an electro(stato)graphic apparatus for printing continuous tone images. The apparatus may print on opaque reflecting supports as well as on transparent supports.

BACKGROUND OF THE INVENTION.

Well accepted printing systems in an "office-environment" as e.g. ink-jet printers and electrostatographic printers, are not used as much as would be expected when the convenience of these systems is considered. Most of these printers can only partially print continuous tone images and the continuous tone image has to be specially treated (e.g. by a dither method) before the print can be made. In this context, a continuous tone image or contone image is an image containing grey levels, with no perceptible quantisation to them. This drawback has hampered the use of these very convenient printers in those imaging areas where it is important to accurately print continuous tone images as e.g. in pictorial photography, medical imagery, etc.

In an ink-jet printer, a convenient printing system for use in an office environment, it has been proposed in EP-A-0 606 022 to use different inks, with different pigmentation and to use the ink with low pigmentation to print the low densities and the ink with high pigmentation to print the high densities. In this technique use is made of ink drops with volumes ranging from 25 to 100 $\mu$l in the so called bubble jet based systems, or with volumes in the range of 5 to 10 $\mu$l in the so called continuous jet systems. In all cases the images are built up by combining in an appropriate way such drops on the substrate, and although the addressability of each drop typically lies in the range of 300 dpi (dots per inch) to 1200 dpi, the not fully reproducible way the dot spreads and penetrates in the substrate limits the real resolution in the printed image. Hereinafter the resolution of image will be described in dpi, a normal description in the printing business. Further attempts to reproduce continuous tone images using light- and dark-colored inks have been described in EP-A-0 606 022 and U.S. Pat. No. 4,860,026.

Electro(stato)graphic printers are evenly well accepted imaging systems in an "office environment" as ink-jet printing since these systems, e.g. electrophotographic copiers, electrographic printers, Direct Electrostatic Printing (DEP), are convenient, fast, clean and do not need aqueous solutions. Since electro(stato)graphic systems may use solid particles that typically have a particle diameter between 1 and 10 $\mu$m as marking particle, it is possible to achieve very high resolution in electro(stato)graphy.

However, most electro(stato)graphical imaging systems, are not intrinsically capable of forming continuous tone and special measures have to be taken to print continuous tone images.

Continuous tone printing in electrophotographic printing by a laser beam is described in the Journal of Imaging Technol., Volume 12, n° 6 December 1986 on pages 329 to 333 in an article entitled "Electrophotographic Color Printing Using Elliptical Laser Beam Scanning Method". In this article a dot matrix method, combined with pulse-width modulation of the laser beam (to be able to introduce in each dot of the matrix several density levels) and with an elliptical laser beam, is described to achieve a continuous tone reproduction with sufficient resolution and linearity over a tone range of 256 levels. Although with such a printing system quality continuous tone prints can be made, there are still some problems to be addressed. On an electrostatic photoreceptor there is a threshold level of toner adhesion : this means that in the low density areas, where the electrostatic latent image is weak and is situated just above that threshold, the system shows inherently some instability in the low density areas. Also, since the low density areas are printed using very few toner particles, the granularity (in other terms graininess or noise) in the low density areas becomes easily objectionable for high quality prints.

In Patent Abstract of Japan vol. 007 no. 290 (p. 245), Dec. 24, 1983 & JP-A-58 162970 (Hitachi Seisakusho KK), Sep. 27, 1983 a second toner having a same color and a lower color density (1.0 black density) is added to a first toner (1.8 black density) in a 4:1 ratio to obtain a good gradation.

In U.S. Pat. No. 5,142,337 a second toner is used, comprising a mixture of opaque black, opaque white and clear toner. A second toner layer is applied on top of a first toner layer, comprising black toner.

In proceedings of the International Congress on Advances in on-Impact Printing Technologies, San Diego, Nov. 12–17, 1985, no. Congress 5, Nov. 12, 1989, Moore J., pages 331–341, Kunio Yamada et al 'Improvement of halftone dot reproducibility in laser-xerography', the author discusses graininess of the xerographic process, mainly influenced by dot growth.

In EP-A-0 275 636 a cyan, magenta, yellow and black toner combination is disclosed for color printing applications.

In Journal of Imaging Technology, vol. 15, no. 5, October 1989, pages 198–202, Tanaka T 'Color Reproduction in Electrophotography: a layered model', Tanaka discloses a method predicting color from color toner weight and vice versa.

The intrinsic qualities of electro(stato)graphic printers (speed, resolution, cleanness, dry operationable) have not yet been used in instances where speed, cleanness and dry operationability are highly wanted, just because of the problems cited above. A particular, but not limiting, example of an area where electro(stato)graphic printing could advantageously be used, if good, stable, high resolution half-tone (continuous tone) printing over at least 256 printed (not only addressed) density levels were possible, is the medical hard-copy sector.

There is thus need for electro(stato)graphic systems being capable of printing continuous tone images.

OBJECTS OF THE INVENTION

It is an object of the present invention to provide an apparatus suitable for stable and reliable generation of large amounts of tone values.

It is an other object of the invention to provide an apparatus for electro(stato)graphic printing making it possible to print at least 256 monochrome or color density levels in a stable way.

It is a further object of the invention to provide a system for electro(stato)graphic printing making it possible to print continuous tone images with reduced noise.

It is still another object of the invention to provide a system for electro(stato)graphic printing making it possible to print in a rapid, clean, dry and stable way high resolution continuous tone images.

It is a further object of the invention to provide a system for electro(stato)graphically printing images obtained during medical diagnosis.

Other objects and advantages of the present invention will become clear from the detailed description hereinafter.

SUMMARY OF THE INVENTION

The above mentioned objects are realised by an apparatus comprising the specific features according to claim 1. Specific features for preferred embodiments of the apparatus according to the invention are set out in the dependent claims. At least two toner types, having substantially the same chromaticity, are used. Chromaticity describes objectively hue and saturation of a color, and may be measured in terms of CIE x,y or u',v' (cfr. "The reproduction of color in photography, printing & television" by R. W. G. Hunt, 4th edition 1987, ISBN 0 86343 088 0, pp. 71–72). The term "substantially the same" means that, as expressed in the approximately uniform CIE L*a*b* color space, the following holds $$\sqrt{(\Delta a^*)^2 + (\Delta b^*)^2} \leq 20$$

Because the chromaticity of toner particles, fused to a substrate, may be different from that of the original toner particles, the chromaticity referred to is that of the toner particles appearing on the final substrate. Those two toner types may be identical, but preferentially the coloring power of each toner type is different. In a preferred embodiment, each toner type is applied in a subsequent toning step, e.g. by a different toner station. In a preferred embodiment, the different coloring power is obtained by a different degree of pigmentation. In one embodiment, at least two achromatic toners are used, i.e. greyish or black toners of which the chromaticity is substantially zero.

In a preferred embodiment, cells are printed by applying a number (N) of different types of toner particles, preferably by N toner stations, said toner particles having an average volume diameter $d_{v50}$, and wherein said number N fulfils the relation $N \geqq 0.3 \times d_{v50}$ and wherein N is determined by adding 0.5 to $0.3 \times d_{v50}$ and rounding to the next lower integer.

In a further preferred embodiment $N \geqq 0.4 \times d_{v50}$ and N is determined by adding 0.5 to $0.4 \times d_{v50}$ and rounding to the next lower integer.

DETAILED DESCRIPTION OF THE INVENTION

The invention is described hereinafter by way of examples with reference to the accompanying figures wherein.

Figure 1:
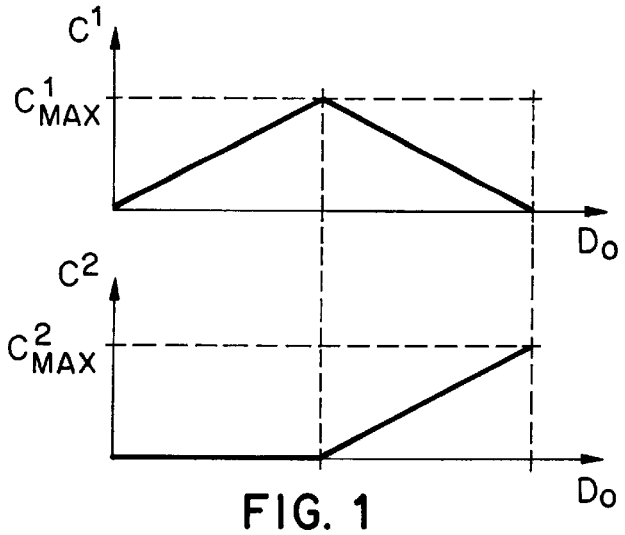
FIG. 1 shows an amount or toner concentration $C^1$ of a first toner as a function of the required optical density $D_0$ on a substrate along with a toner concentration $C^2$ of a second toner, as a function of the same required optical density $D_0$, according to a specific printing system according to the current invention.

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims.

This application is concerned with any printing apparatus wherein an image is formed by the deposition of particulate marking species. In particular this application is concerned with two electro(stato)graphic printing systems. One is the classical electrographic printer, where an electrostatic latent image, on a latent image bearing member, is developed by toner particles, whereafter the developed image can, but may not, be transferred to a final substrate. Another apparatus is based on Direct Electrostatic Printing (DEP), wherein toner particles are imagewise deposited on a substrate without the use of an electrostatic latent image.

By the apparatus according to the current invention, a monochrome image or a color image may be reproduced. A monochrome image may be referred to as a black and white image, with continuous tone grey levels. The monochrome image may also be obtained by capturing a color image by only one spectral band, such that a digital image is obtained for which each picture element or pixel can have one value, corresponding to a specific tone level. Also color separations, giving a yellow, magenta, cyan and black image of a continuous tone color image are, in the present invention also designated by monochrome image. A color image may be obtained by superposition of different color separations. In a preferred embodiment, the traditional color components cyan, magenta and yellow, are augmented with at least one extra color component according to one toner type in a toner station. This extra color component may have another density or coloring power of either cyan, magenta or yellow. In another embodiment, a traditional black component is added to the three usual color components and a grey component is added to vary the black and grey components in a system according to the current invention. In another embodiment, for each traditional color component, CMY or CMYK, at least a second color component, having a lower pigmentation level, C'M'Y'(K') is added.

Usually the number of tone levels per color component is chosen to be 256, and the pixel values vary from 0 to 255 accordingly.

An electrographic device (electrostatographic, electrophotographic, etc.) can address different locations on the substrate in order to supply to each location a specific amount of toner. At each such location, a dot of toner particles may be deposited by the electrographic device. Because such location constitutes the smallest dot that can be addressed and deposited by the electrostatic device according to the invention, such location is called a microdot. The whole substrate can now be partitioned in a plurality of adjacent, non-overlapping or disjunctive microdots. Usually the shape of each microdot is square. In typical electrographic devices, 300 up to 600 microdots may be arranged side by side on one inch, in which case the "resolution" of the device is said to be 300, respectively 600, dots per inch (dpi). Microdots may also have a rectangular shape, and/or may be arranged on the substrate in oblique directions rather than in two orthogonal directions. Microdots may also have a hexagonal shape and an appropriate arrangement in order to fill up the complete substrate. By addressing the marking engine of the output device, a specific amount of toner particles is deposited for one microdot. Preferentially the toner particles are deposited within the boundaries of the microdot. Usually the toner particles are deposited according to a Gaussian distribution, having its centre close to the centre of the microdot. It is possible that toner particles, intended for a specific microdot, partially or fully fall within a neighboring microdot. Although the microdots are disjunctive from each other, it is possible that toner particles of adjacent microdots are not disjunctive.

In a preferred embodiment according to the current invention, the electrographic device may supply at least three different amounts of one toner to each microdot. By the amount of toner is meant the concentration or toner deposition level, which may be expressed in milligram toner per square centimeter [$mg/cm^2$]. A different concentration may be obtained by pulse width modulation of an electronic signal e.g. when monitoring the exposure of a photosensitive semiconductor drum by a laser beam; or by pulse height or amplitude modulation ; or any other measure in order to modulate the concentration within or attributable to one microdot. A microdot may get no toner at all or a "low amount" of toner, which means that the toner concentration, measured by the amount of toner deposited for that microdot and related to the area of that microdot, is less than 10% of the maximum toner concentration (e.g. 10 $mg/cm^2$); a microdot may get a "high amount" of toner, which means that the toner concentration within such microdot is higher than 70% of the maximum toner concentration for the current application; a microdot may get also a "medium amount" of toner, which means that the toner concentration is between 10% and 70% of the maximum toner concentration. Preferentially, apart from these three toner concentrations, more toner concentrations may be available. In a preferred embodiment, sixteen levels of toner concentration for each microdot and for each toner type are established.

Because of the restricted contone capabilities of the electrographic device, i.e. only sixteen different optical density levels achievable per microdot, a process of halftoning is applied to the contone images. Because each microdot can get more than two toner concentrations in the halftone scheme, this type of halftoning is called multilevel halftoning. Two major types of multilevel halftoning exist: halftone dot size modulation and frequency modulation. For halftone dot size modulation, halftone dots, comprising a plurality of microdots, are laid out on a periodic grid having a screen ruling and a screen angle. In order to achieve a higher optical density, more microdots carrying toner are added to the halftone dot. This corresponds with an autotypical raster in traditional binary screening techniques. In frequency modulation, halftone dots are created from a fixed number of microdots, maybe just one microdot, and the distance between such halftone dots is varied, rather than their size. For both techniques, adjacent microdots are preferentially, but not necessarily, arranged in cells, called halftone cells for autotypical screening techniques. By the term adjacent is meant that microdots touch each other by one side or by a corner. Also for frequency modulation techniques, a plurality of microdots may be arranged in one cell. Each cell comprises preferentially the same number of microdots, has the same shape and the cells are arranged such that the whole substrate may be tiled by adjacent cells.

According to a specific embodiment of the current invention, the apparatus has at least two toner stations with different toners such that some tone levels of the original image are reproduced by applying two different toners, having substantially the same chromaticity, or more specifically two achromatic toners, to one cell. An achromatic toner is a greyish or black toner. If a low density must be realised within a cell on the substrate, just one toner may be applied to the cell. A higher optical density within that cell, may be realised by applying a large amount of greyish toner and a low amount of black toner to the cell. It is important to select the distribution of each toner type over the cell such, that the stability of the electrographic process is not jeopardized. It has been found that toner application to microdots is most stable, predictable and reproducible if either a low amount or a large amount is supplied to the microdot. In order to exploit the multilevel capabilities of the electrographic device, at least one microdot within a cell or region, comprising adjacent microdots, must have the possibility to get a medium amount of toner. Typically, for a cell consisting of four microdots, arranged in a 2×2 fashion, three microdots, i.e. a large majority of microdots, preferentially get a "stable amount" of toner, i.e. they may get no or a minimum amount of toner or a maximum amount of toner. The other microdots, being a minority, in this example just one microdot, may be supplied with a medium amount of toner. Where frequency modulation techniques are used, a cell may comprise as much as 256×256 microdots. By a large majority is meant 66% or more. In a preferred embodiment, a large majority ($\geqq 66\%$) of microdots within a region is supplied with either a high or low amount of one toner, whereas the other microdots (a minority) are supplied with a medium amount of said toner. In other words: only a minority of microdots (i.e. no microdots or any number $\leqq 34\%$) within a region or cell is supplied with a medium amount of toner.

Implementations of frequency modulation, which are designed for speed, are tile-based, where the tiles correspond to periodic cells of typically a few hundred by a few hundred microdots. Implementations which are not tile based are generally based on some variant of an error-diffusion algorithm. Where frequency modulation techniques are used, a cell may comprise 256×256 microdots or there may be no cell at all if an error diffusion algorithm is used. In these cases it makes sense to replace the notion of cell by a local environment or "region" of a particular microdot. The extent of the environment is to be chosen such that several halftone dots are within the environment. For such an environment one can determine the number of microdots which get a stable amount of toner. For binary error diffusion variants all the microdots get a 'stable' amount of toner. Alternatively, a hybrid error diffusion technique may be used, based on cell level, instead of based on microdot level, wherein each multilevel halftone cell comprises a plurality of adjacent microdots.

When several types of toner particles are applied to one cell, it is possible that a microdot gets a low, medium or high amount of the first type of toner, whereas the same microdot may get also a low, medium or high amount of the second toner type. It is important that per toner type a large majority of microdots within a cell gets either a high or low amount of that specific toner. Examples below will show that one microdot within a cell may get a medium amount of first toner, while another microdot within the same cell may get a medium amount of second toner.

In U.S. Pat. No. 4,714,964 a system is described for multi-level halftoning, making use of two different inks. As may be noticed from grey levels 4 and 12 in FIG. 1 and grey levels 4 and 8 in U.S. Pat. No. 4,714,964, a large majority of medium amounts of ink may be imaged, which gives unstable and unpredictable tone levels with most multilevel electrographic devices. This problem is solved according to the current invention by imposing to the printing device that a large majority of the microdots within a cell must have either a low or a high amount of toner. Whereas intermediate tone levels or optical density levels must be achieved within a specific cell, at least one microdot within that cell preferentially has a low amount of toner, at least one microdot has a high amount of toner and, in order to achieve fine tone gradations, at least one microdot has a medium amount of toner. According to U.S. Pat. No. 4,714,964 either a low-concentration or a high-concentration ink is deposited on one microdot. We have found that the perceived noise level of the reproduced image may be substantially improved by printing at least two toner types having substantially the same chromaticity on top of each other within one microdot for specific density levels.

The reproducing or printing device, according to the present invention, can be operated either with liquid electrostatographic development (using a dispersion of solid toner particles in a dielectric liquid) or with dry electrostatographic developers. The dry developers can be monocomponent developers (comprising toner particles, but no carrier particles) as well as multi-component developers (comprising toner and carrier particles).

It was found, using developers that comprise toner particles with an average volume diameter in the micrometer range, that the minimum number (N) of types of toner particles depended on the volume average size (in $\mu$m) of the toner particles used. When toner compositions are used comprising toner particles having different volume average diameter ($d_{v50}$ in $\mu$m) the number (N) of types of toner needed for good printing depends on the largest $d_{v50}$ used in printing.

It was found that the number N should at least be equal to $0.3 \times d_{v50}$, wherein N is determined by adding 0.5 to $0.3 \times d_{v50}$ and rounding to the next lower integer. In this case, when using toner compositions comprising toner particles with a particle size distribution wherein $5\ \mu m \leqq d_{v50} \leqq 8\ \mu m$, N is at least 2.

It is however preferred to use N toning steps, where N is at least equal to $0.4 \times d_{v50}$, wherein N is determined by adding 0.5 to $0.4 \times d_{v50}$ and rounding to the next lower integer. In this case, when using toner composition comprising toner particles with a particle size distribution wherein $7\ \mu m \leqq d_v50 \leqq 8\ \mu m$, N is at least 3.

The toner compositions of the number N types of toner particles, preferably differ in degree of coloring power (i.e. the density achievable in the final image). The coloring power of the type of toner having the lowest coloring power ($T_1$) is, for a given amount of deposited toner, preferably such that $T_1$ gives, between 10 and 50% of the density given by the toner particles having the highest coloring power ($T_{max}$), when the same amount of particles (expressed in mg/cm$^2$) is deposited. In a more preferred embodiment said toner composition $T_1$, not only has the lowest degree of coloring power, but comprises also toner particles having a particle size distribution showing the lowest volume average diameter. In relative terms the toner particles comprised in toner composition $T_1$ have a $d_{v50}$ that is at least 1.5 to 2.5 times smaller than the $d_{v50}$ of the toner particles comprised in the toner having the highest coloring power ($T_{max}$).

The coloring power of the toner particles comprised in the various toner compositions is chosen such that in the final image between 0.1 and 2 mg/cm$^2$ of toner is present.

When the original image to be printed in a printing system, according to the present invention, on the opaque reflecting substrate is an image of a medical diagnostic apparatus, it is possible that the dynamic range of the original exceeds the dynamic range of the recording medium, since the $R_{min}$ achievable on an opaque reflecting substrate is around 0.01, amounting to a maximum density around 2.00. Thus the difference between the highest and lowest reflectance is around a factor 100, whereas an original medical image can have a difference in intensities around 1000. Therefore it may be beneficial to divide the dynamic range of the original into several portions each of these portion not having a dynamic range exceeding the dynamic range of the recording medium. A way of doing so has been described in EP-A-0 679 015, that is incorporated herein by reference.

The opaque reflecting support used in the present invention can be paper, polyethylene coated paper, an opaque polymeric reflecting substrate, etc. Opaque reflecting polymeric substrates, useful as a final substrate to be used according to this invention, are e.g. polyethyleneterephthalate films comprising a white pigment, as described in e.g. U.S. Pat. No. 4,780,402, EP-A-0 182 253. Preferred however are polyethyleneterephthalate films comprising discrete particles of a homopolymer or copolymer of ethylene or propylene as described in e.g. U.S. Pat. No. 4,187,113. Most preferred are opaque reflecting final substrates comprising a multi-ply film wherein one layer of said multi-ply film is a polyethyleneterephthalate film comprising discrete particles of a homopolymer or copolymer of ethylene or propylene and at least one other layer is a polyethyleneterephthalate film comprising a white pigment as described in e.g. EP-A-0 582 750 and Japanese non-examined application JN 63/200147.

Especially when the opaque reflecting final substrate is either polyethylene coated paper or an opaque reflecting polymeric substrate, it has proven beneficial to coat a toner receiving layer onto said substrate. This toner receiving layer comprises a binding agent or mixture of binding agents. As binding agent (binder) preferably thermoplastic water insoluble resins are used wherein the ingredients can be dispersed homogeneously or form therewith a solid-state solution. For that purpose all kinds of natural, modified natural or synthetic resins may be used, e.g. cellulose derivatives such as ethylcellulose, cellulose esters, carboxymethylcellulose, starch ethers, polymers derived from $\alpha,\beta$-ethylenically unsaturated compounds such as styrene, polyvinyl chloride, after-chlorinated polyvinyl chloride, copolymers of vinyl chloride and vinylidene chloride, copolymers of vinyl chloride and vinyl acetate, polyvinyl acetate and partially hydrolysed polyvinyl acetate, polyvinyl alcohol, polyvinyl acetals, e.g. polyvinyl butyral, copolymers of acrylonitrile and acrylamide, polyacrylic acid esters, polymethacrylic acid esters and polyethylene or mixtures thereof. A particularly suitable ecologically interesting (halogen-free) binder is polyvinyl butyral. Polyvinyl butyral containing some vinyl alcohol units is marketed under the trade name BUTVAR B79 of Monsanto USA.

The printing of a continuous tone image on a transparent substrate proceeds basically as described above for the printing of a continuous tone image on an opaque reflecting support. The transparent supports can be made of glass or of a polymeric resin. The polymeric resin substrate can be a polyester, e.g. polyethyleneterephthalate, polyethylenenaphthalate, polycarbonates, polyolefinic film, etc. The final substrate (either transparent or opaque), whereon the printing by a device according to the present invention proceeds, can be present as sheet or as web material.

When the continuous tone image is printed on a transparent support, be it by a DEP process or by classical (regular) electro(stato)graphy, the obtainable maximum transmission density is around 2.00. This is due to the definite size of the toner particles, the limited amount of pigment that can be incorporated in toner particles without negatively influencing the quality of the toner particles and to the finite amount of toner particles that can be deposited on the electrostatic latent image. The amount of toner particles that can be deposited in classical electro(photo)graphy is typically between 5 $g/m^2$ to 10 $g/m^2$, i.e. 0.5 to 1 $mg/cm^2$. This transmission density level is acceptable in e.g. transparencies for overhead projection, but is not satisfactory for e.g. medical images that are viewed on a light box. Even for prints made on reflecting supports, higher maximum densities are desirable. Moreover, when larger surfaces of maximum density are present, some micro-voiding exists. This micro-voiding (low density micro-spots within a surface of maximum density) deteriorates the quality of the print.

It has proven beneficial, even when printing on an opaque reflecting support, but especially when the printing of the original image proceeds on a transparent support, that at least the toner composition $T_N$ comprises one or more ingredients that together or in cooperation with ingredients comprised in the final substrate are capable of forming a light absorbing substance and said toner particles optionally comprise a light absorbing pigment or dye.

In a preferred embodiment said ingredients, comprised in said toner particles that together or in cooperation with ingredients comprised in said final substrate are capable of forming a light absorbing substance, are at least one reductant (compound A) and at least one substantially light insensitive silver salt (compound B).

In a further preferred embodiment said reductant (compound A) is incorporated in said toner particles and said substantially light insensitive silver salt (compound B) is incorporated in said final substrate.

In a further preferred embodiment the reaction between reductant (compound A) and substantially light insensitive silver salt (compound B) is aided by an auxiliary reductant C. In such a case there is a difference between the pigmentation of the toner type and the coloring power of the toner type. The pigmentation refers to the amount of pigments added to the toner during the fabrication process. The coloring power refers to the optical density in reflection or transmission obtained for a specific concentration [$mg/cm^2$] of the toner as applied and fused to the substrate, thus after reaction if any.

In a most preferred embodiment, said substantially light insensitive silver salt is a silver salt of a fatty acid, wherein the aliphatic carbon chain has preferably at least 12 C-atoms and said reductant is a di- or tri-hydroxy compound.

Substantially light insensitive organic silver salts suited for use according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, and likewise silver dodecyl sulphonate described in US-A-4,504,575 and silver di-(2-ethylhexyl)-sulfosuccinate described in published EP-A-0 227 141. It is most preferred to use silverbehenate in the apparatus according to the present invention.

Well suited organic reducing agents for use in the reduction of said substantially light insensitive silver salts are catechol-type reducing agents, by which is meant reducing agents containing at least one benzene nucleus with two hydroxy groups (—OH) in ortho-position, e.g., catechol, 3-(3,4-dihydroxyphenyl) propionic acid, 1,2-dihydroxybezoic acid, methyl gallate, ethyl gallate, propyl gallate, tannic acid and 3,4-dihydroxy-benzoic acid esters. Preferred reductants are gallic acid or derivatives thereof.

The reductant to be used in an electrostatographic printing system according to the present invention, can in fact be a mixture of (a) primary, relatively strong reducing agent (compound A), as described above; and, (b) a less active auxiliary reducing agent (compound C) that form together a synergistic (superadditive) reducing mixture.

As less active auxiliary reducing agents (compound C) preferably sterically hindered phenols are used.

It is possible that the light absorbing product formed by reaction of compounds A and B does not give a neutral black image tone in the higher densities nor a neutral grey image tone in the lower densities. Therefore toning agents (compound D), known from thermography or photothermography may be added in the process. Said toning agents can be incorporated in the toner particles or in the final image receiving substrate.

The transparent final substrate comprises a toner receiving layer coated on a transparent support. Said toner receiving layer comprises a binding agent or mixture of binding agents, that can be the same as those mentioned above. Since printing of high densities (D>2.00) is preferred, it is preferred that said toner receiving layer comprises also compounds A, B or C, or mixtures thereof and optionally toning agents (compound D). The toner receiving layer can also comprise waxes or "heat solvents" also called "thermal solvents" or "thermosolvents" improving the penetration of the reducing agent(s) and thereby the reaction speed of the redox-reaction at elevated temperature.

The transparent support is preferably a polymeric support. A wide variety of such supports are known and are commonly employed in the art. They include, for example, transparent supports as those used in the manufacture of photographic films including cellulose acetate propionate or cellulose acetate butyrate, polyesters such as poly (ethyleneterephthalate), poly(ethylenenaphthalate), polyamides, polycarbonates, polyimides, polyolefins, poly (vinylacetals), polyethers and polysulfonamides. Polyester film supports and especially poly(ethyleneterephthalate) and poly(ethylenenaphthalate) are preferred because of their excellent properties of dimensional stability. When printing medical images, it is preferred to use a blue colored transparent film substrate, especially a blue dyed polyester support.

Toner compositions and substrates as described above have been disclosed in detail in EP-A-0 706 094, that, in its totality, is incorporated herein by reference.

The toner particles for use in a printer for printing a continuous tone image on an opaque reflecting substrate as well as on a transparent substrate according to the present invention, can essentially be of any nature as well with respect to their composition, shape, size, and preparation method and the sign of their tribo-electrically acquired charge.

The toner particles used in accordance with the present invention may comprise any conventional resin binder. The binder resins used for producing toner particles according to the present invention may be addition polymers e.g. polystyrene or homologues, styrene/acrylic copolymers, styrene/methacrylate copolymers, styrene/acrylate/acrylonitrile copolymers or mixtures thereof. Addition polymers suitable for the use as a binder resin in the production of toner particles according to the present invention are disclosed e.g. in BE-A-61.855/70, DE-A-2 352 604, DE-A-2 506 086, U.S. Pat. No. 3,740,334.

Also polycondensation polymers may be used in the production of toner particles according to the present invention. Polyesters prepared by reacting organic carboxylic acids (di- or tricarboxylic acids) with polyols (di- or triol) are the most preferred polycondensation polymers. The carboxylic acid may be e.g. maleic acid, fumaric acid, phthalic acid, isophthalic acid, terephthalic acid, trimellitic acid, etc or mixtures thereof. The polyolcomponent may be ethyleneglycol, diethylene glycol, polyethylene glycol, a bisphenol such as 2,2-bis(4-hydroxyphenyl)-propane called "bisphenol A" or an alkoxylated bisphenol, a trihydroxy alcohol, etc, or mixtures thereof. Polyesters, suitable for use in the preparation of toner particles according to the present invention are disclosed in e.g. U.S. Pat. No. 3,590,000, U.S. Pat. No. 3,681,106, U.S. Pat. No. 4,525,445, U.S. Pat. No. 4,657,837, U.S. Pat. No. 5,153,301.

It is also possible to use a blend of addition polymers and polycondensation polymers in the preparation of toner particles according to the present invention as disclosed e.g. in U.S. Pat. No. 4,271,249.

In order to modify or improve the triboelectric chargeability in either negative or positive direction the toner particles may contain (a) charge control agent(s).

The toner powder particles useful in a system according to the present invention may be prepared by mixing the above defined binder resin(s) and ingredients (e.g. an inorganic filler, a charge controlling agent, optionally one of the compounds A, B or C, etc) in the melt phase, e.g. using a kneader. The kneaded mass has preferably a temperature in the range of 90 to 140° C., and more preferably in the range of 105 to 120° C. After cooling, the solidified mass is crushed, e.g. in a hammer mill and the obtained coarse particles further broken e.g. by a jet mill to obtain sufficiently small particles from which a desired fraction can be separated by sieving, wind classification, cyclone separation or other classifying techniques.

The toner particles useful according to the present invention may also be prepared by a "polymer suspension" process. In this process the toner resin (polymer) is dissolved in a water immiscible solvent with low boiling point and the toner ingredients (e.g. an inorganic filler, a charge controlling agent, at least one of the compounds A, B or C, etc) are dispersed in that solution. The resulting solution/dispersion is dispersed/suspended in an aqueous medium that contains a stabilizer. The organic solvent is evaporated and the resulting particles are dried. The evaporation of the solvent can proceed by increasing temperature, by vacuum evaporation, by spray-drying as described in, e.g. U.S. Pat. No. 3,166,510, U.S. Pat. No. 3,338,991, electrostatic pulverizing as described in, e.g. GB-A-2,121,203, etc.

The powder toner particles useful according to the present invention may be used as mono-component developer (magnetic as well as non-magnetic), i.e. in the absence of carrier particles but are preferably used in a two-component system comprising carrier particles.

When used in admixture with carrier particles, 2 to 10% by weight of toner particles is present in the whole developer composition. Proper mixing with the carrier particles may be obtained in a tumble mixer.

Suitable carrier particles for use in cascade or magnetic brush development are described e.g. in GB-A-1,438,110. For magnetic brush development the carrier particles may be on the basis of ferromagnetic material e.g. steel, nickel, iron beads, ferrites and the like or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 $\mu$m and more preferably in the range of 30 to 100 $\mu$m.

In a particularly interesting embodiment iron carrier beads of a diameter in the range of 50 to 200 $\mu$m coated with a thin skin of iron oxide are used. Carrier particles with spherical shape can be prepared according to a process described in United Kingdom Patent Specification 1,174,571. Carrier beads comprising a core and coated with a Si-containing resin are preferred for use according to the present invention. Such carrier beads have been described in e.g. U.S. Pat. No. 4,977,054 ; U.S. Pat. No. 4,927,728 and EP-A-0 650 099.

The printing, according to the present invention, can proceed in any electrostatographic printing device that incorporates several toning stations. Typical examples of useful printing device are color printers having mostly 4 toning stations (one for yellow toner, one for magenta toner, one for cyan toner and one for black toner) wherein monochrome printing with the differently pigmented toners can proceed. As apparatus suitable for the implementation of the printing according to the present invention can be named CHROMAPRESS (trade name of Agfa-Gevaert NV Mortsel, Belgium).

An apparatus as CHROMAPRESS is very useful, while up to 10 toning stations are present. This opens the possibility for even better monochrome low density printing by using, at least for printing the image $I_1$, yellow, magenta and cyan toners with adapted pigmentation to produce grey tones.

EXAMPLES

Figure 2:
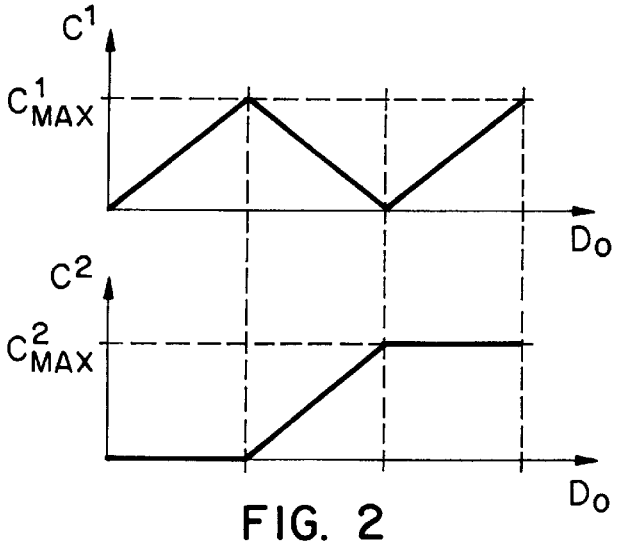
FIG. 2 shows the same variables as FIG. 1, with respect to another embodiment.
Figure 3:
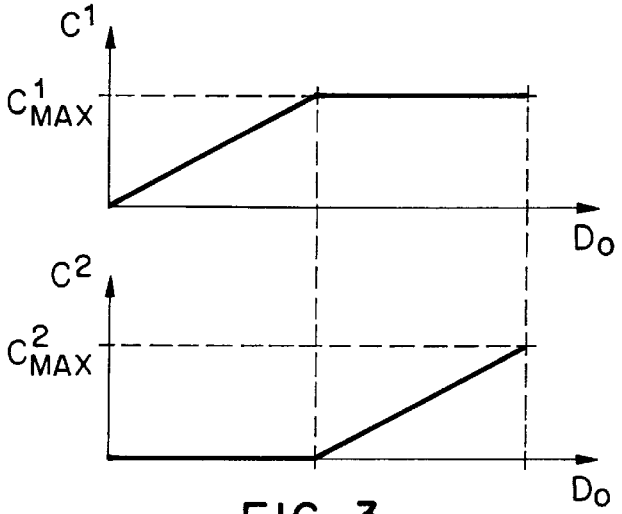
FIG. 3 shows the same variables as FIG. 1, with respect to yet another embodiment.
Figure 4:
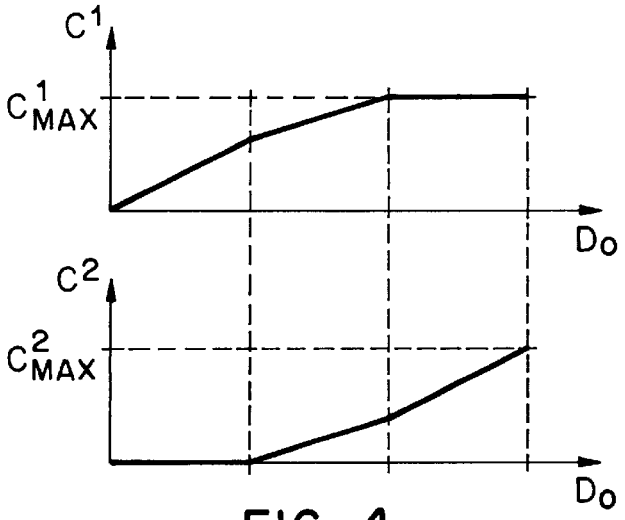
FIG. 4 shows the same variables as FIG. 1, with respect to still another embodiment.
Figure 5:
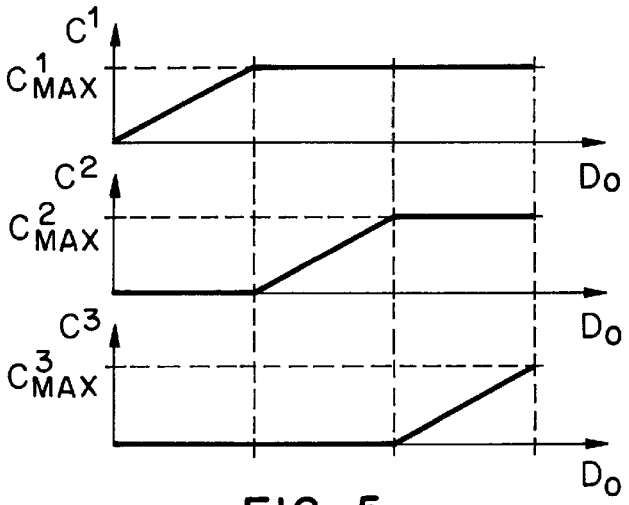
FIG. 5 shows the same variables as FIG. 1, with respect to another embodiment and involving three toners with concentration $C^1$, $C^2$ and $C^3$ respectively.
Figure 6:
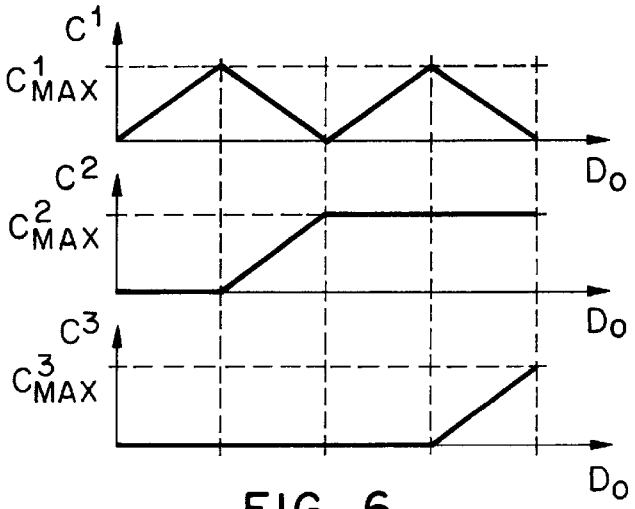
FIG. 6 shows the same variables as FIG. 5, with respect to another embodiment.

According to FIG. 3, in order to achieve a fine tone scale, indicated as $D_0$ in abscissa, the amount (e.g. $C^1$) of deposited toner of at least one toner composition is varied in a predefined, preferentially monotonous manner, as the optical density of the result $D_0$ increases. In order to save toner, it is also possible that the amount of deposited toner is not a monotonous function across the complete tone-scale. This is clarified by FIG. 1. Although the noise level may be reduced by superposition of several types of toner, it is beneficial to restrict the total amount of toner per microdot, preferably to 2 mg/cm$^2$. This is especially true if too high concentrations of toner particles tend to crack if the page or substrate is bent. Large toner concentrations may also cause inconvenient embossed type. FIGS. 2 and 4 show that other toner amounts as a function of the required optical density $D_0$ are achievable. Boundary points, where monotonicity is disrupted, are indicated by the vertical dashed lines in FIGS. 1–4. It is within the scope of the present invention to select different values for the deposited toner mass or amount of toner $C_i$ of a particular toner composition i for the different boundary points, while some toner compositions can have arbitrary deposited mass and optionally change the rate of increase at some of the boundary points, as in the example of FIG. 4. In FIGS. 5–8 configurations are shown for use of three toners, preferentially at three different toner stations. In order to achieve a specific optical density $D_0$, the respective toner concentrations $C^1$, $C^2$ and $C^3$ may be found by using the three graphs in one of the figures. According to FIG. 5, toner concentrations are never descending. This option requires a serious total amount of toner, but has proven to be the most stable imaging method. According to FIG. 6, the toner amount of the first toner is ascending as a function of increasing density $D_0$ as long as the toner amounts for the second and third toners are constant. Whenever the toner amount for either the second or the third toner increases, the toner amount for the first toner decreases as a function of increasing density $D^0$.

Figure 7:
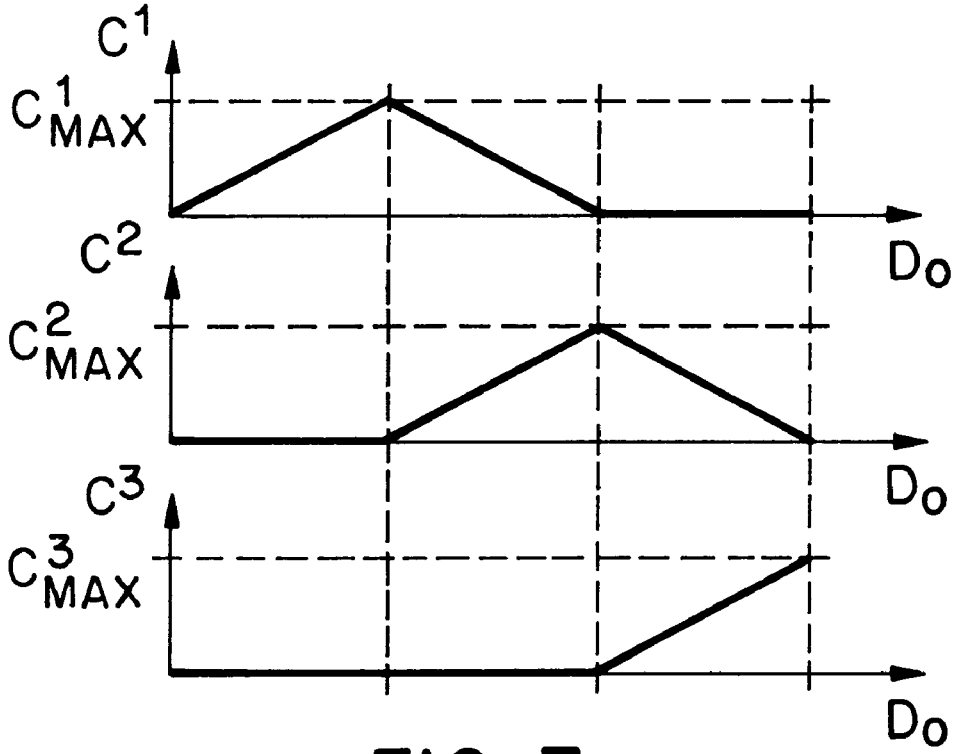
FIG. 7 shows the same variables as FIG. 5, with respect to yet another embodiment.
Figure 8:
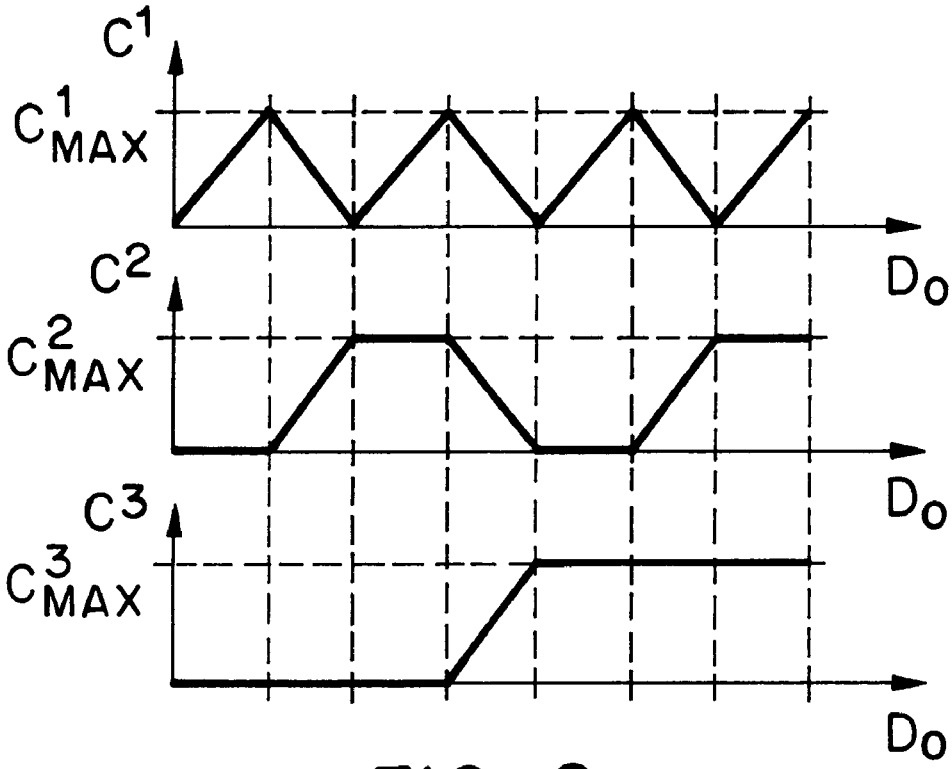
FIG. 8 shows the same variables as FIG. 5, with respect to still another embodiment.

According to FIG. 7, which is more economic from the point of view of toner consumption, the total amount of toner is never larger than the largest amount of one toner. According to FIG. 8, all possible combinations of toner amount are exhausted. This allows for most optimal choice of possible toner concentrations.

From FIGS. 1–8 it is thus clear that different portions of the tone scale $D_0$ may be printed with different combinations of layers, where some of the toner compositions may have a fixed deposited amount, some toner compositions or types of toner, having substantially the same chromaticity, may be absent, some toner compositions may have an increasing deposited toner amount, and some toner compositions—preferably having a lower pigmentation—may even decrease the deposited mass or toner amount, while the deposited mass of a higher pigmented toner composition increases as the tone $D_0$ to be printed increases.

PRINTING EXAMPLES

| PREPARATION OF THE TONER PARTICLES | |
|---|---|
| Polyester (ATLAC T500)* | 96 parts |
| Carbon Black ** | x parts |
| Tetrabutylammoniumbromide | 0.5 parts |

*ATLAC is a registered trade name of Atlas Chemical Industries Inc. Wilmington, Del. U.S.A.) and ATLAC T500 is a linear polyester of fumaric acid and propoxylated bisphenol A.
** CABOT REGAL 400 (trade names of Cabot Corp. High Street 125, Boston, U.S.A.).

Three toner compositions were prepared with varying concentration Carbon Black:

A: 0.20% of carbon black giving for 6 g/m$^2$ of fixed toner a minimal reflectance ($R_{min}$) of 0.61;

B: 0.45% of carbon black giving for 6 g/m$^2$ of fixed toner an $R_{min}$ of 0.38; and, C:5% of carbon black giving for 6 g/m$^2$ of fixed toner an $R_{min}$ of 0.02.

The ingredients were melt kneaded at 110° C. for 30 min, after cooling, crushing and milling toner particles with a volume average particle size of 8.0 $\mu$m and a coefficient of variability $\nu$=0.25 were obtained. 100 parts of these toner particles were mixed with 0.5 parts of $SiO_2$ (AEROSIL R972 tradename of Degussa Frankfurt/M-Germany.

CARRIER PARTICLES

A Cu—Zn ferrite based coated carrier was prepared by coating a Cu—Zn ferrite core with 1% of dimethylsilicone using a solution spraying technique in a fluidized bed and post curing the coating. The carrier showed a saturation magnetization ($M_{sat}$) of 0.41 Tesla. The particle size distribution was characterized by:

$d_{v50\%}$=52.5 $\mu$l, $d_{v10\%}$=32 $\mu$m and $d_{v90\%}$=65 $\mu$m.

Three developers ($Dev_1$, $Dev_2$ and $Dev_3$) were prepared accordingly by adding 4% of the respective toner compositions $T_1$, $T_2$ and $T_3$ to the carrier particles. The toners had a charge of −3.7 Fc/10 $\mu$m.

Printing

Figure 11:
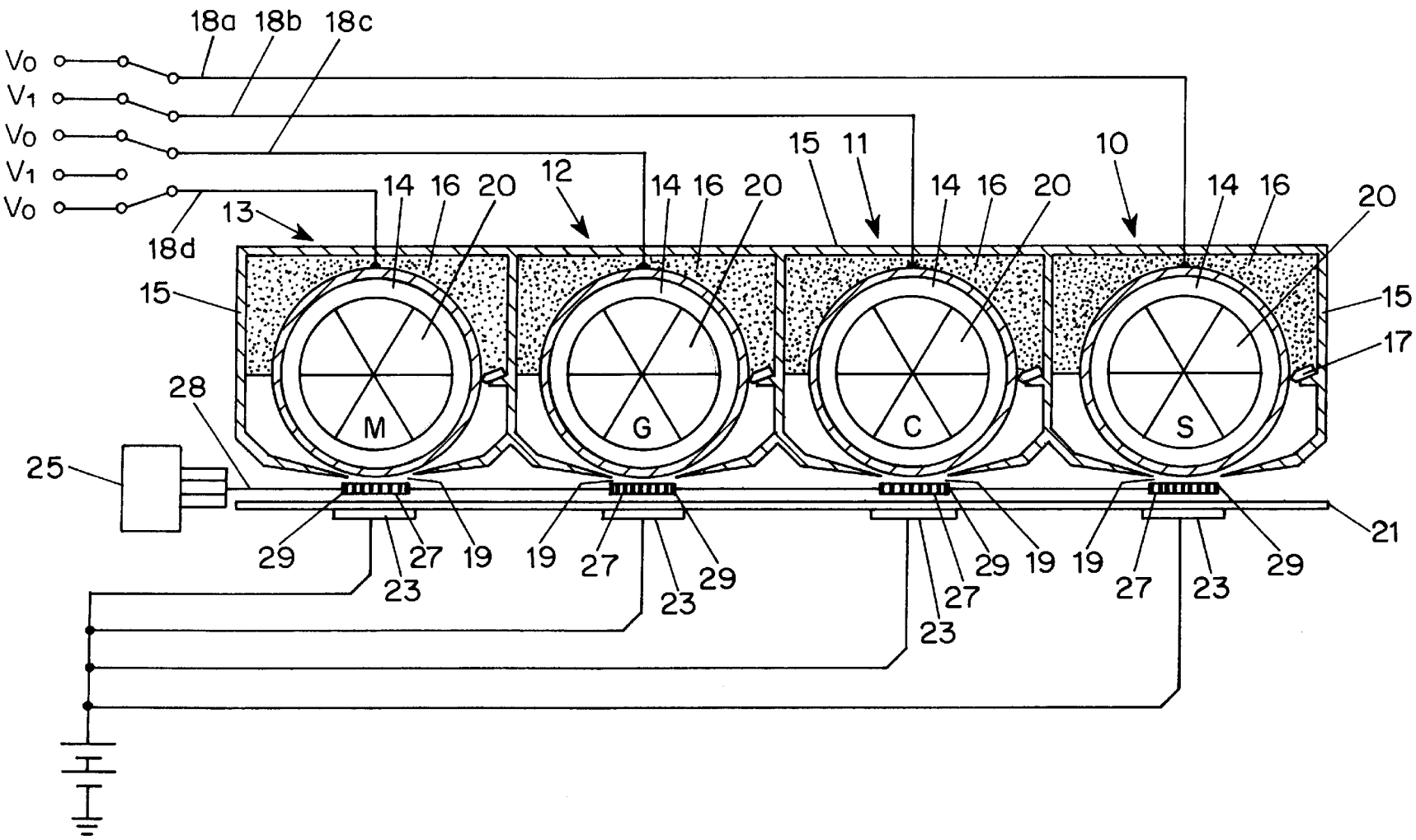
FIG. 11 shows an apparatus according to the current invention, based on direct electrographic printing.

FIG. 11 shows an embodiment of the invention according to Direct Electrostatic Printing, based on a color printer disclosed in DE-A-4 338 992. This figure shows a device consisting of a number, for instance four, separate developers 10–13 or toner stations, each including a toner carrier 14, preferably a conductive developer roller and a container 15 for toner particles 16, even called toner. Each developer normally contains a color, for instance magenta, cyan, yellow and black (M, C, G and S). Three containers 15 may be filled with a different toner, having substantially the same chromaticity. A special scrape device 17, so-called "doctor blade" is provided to produce a uniform layer of toner particles 16 on the toner carrier 14. Each toner carrier 14 includes a core, consisting of a number of permanent magnets 20 with different polarity. These are provided to attract the toner particles 16 to the roller 14. Each of these rollers is individually connectable to a voltage supply by means of switches **18*a*–18*d*, which means that the toner carriers 14 can be supplied by different potentials. The toner particles 16 are transferred to an information carrier 21, which can be a paper sheet, via an opening 19, arranged in the toner container 15, facing the information carrier 21. The transfer occurs by means of attraction forces, which are produced between the toner carrier 14 and at least a back electrode 23. An electrode means 29, consisting of a lattice-shaped electrode layer is arranged between the toner carriers 14 and the back electrodes 23. In this embodiment the electrode layer consists of electrodes 24 of thin conductors, supported on an insulating carrier, in which the conductor and the carrier are provided with pervious apertures 27, to act as passages for said attraction forces. Each aperture addresses one microdot on the surface of the substrate or information carrier 21. The electrodes 24 in the electrode layer are common for all developers 10–13 and connected to a driving device 25**.

In the shown embodiment, the switching unit **18*b* is connected to $V_1$, whereby only one toner carrier 14 with one type of toner particles 16, receives necessary potential, so that the electric field attracts the particles from the toner carrier 14 to the information carrier 21. By means of the signals from the driving device 25, the electrodes 24 are controlled, so that passages for the attraction force in the apertures 27 are opened or closed between the back electrode 23 and the toner carrier 14. By bringing an information carrier 21, eg. a paper sheet, between the developer 10–13 and the back electrodes 23, the toner particles 16 are transported on the information carrier 21. By connecting the electrodes 24 to different voltages, henceforth called ON or OFF-voltage, the toner particles 16 are guided to the information carrier 21. An ON-voltage is a voltage resulting that an "opening" is obtained in the electrode apertures 27 and that the attraction force between the back electrodes 23 and to $V_1$ connected toner carrier 14 causing toners to be applied on the information carrier, while an OFF-voltage prevents the attraction force to reach the toner particles. Through the remaining electrode apertures appurtenant to the developers, which are provided on same signal line, connected to the ON-voltage, no toners pass when non sufficient field strength is obtained between the developer, connected to $V_0$ (for example 0 V), and the back electrodes 23. A connection of the electrode to an ON-voltage, results in the toner being transported to the information carrier. Pervious apertures 27 in electrodes 24, which are not connected to the same signal line 28 of driving device 25, are "closed" by means of OFF-voltage. This is also applied for the remaining electrode apertures belonging to the other developers, which are provided on the same signal line 28. At least one other developer will apply another type of toner to a microdot having toner from a first developer with toner having substantially the same chromaticity. Different adjacent pervious apertures, combined with the movement of the information carrier 21**, are suitable for defining a region of adjacent microdots. By varying the voltages, high, low and medium amounts of toner may be supplied to the individual microdots. The number and arrangement of microdots supplied with these specific amounts of toner may be controlled by controlling the voltages.

According to "Electrographic printing", particles may be used in an embodiment where the electrode matrix is substituted by a "particle modulator", which consists of slit-formed apertures 27 arranged on an insulating plate, adjacent to which is a first electrode layer, so-called signal electrodes, on one side of the plate and another electrode layer, so-called base electrodes on the other side of the plate.

In an electrophotographic type printer, the three developers were charged in the first three toner stations of an Agfa Chromapress printer. Chromapress is a trade name of Agfa-Gevaert N.V. in Mortsel Belgium. This printer has ten toner stations, five at each side of the substrate (paper) to be printed.

Figure 12:
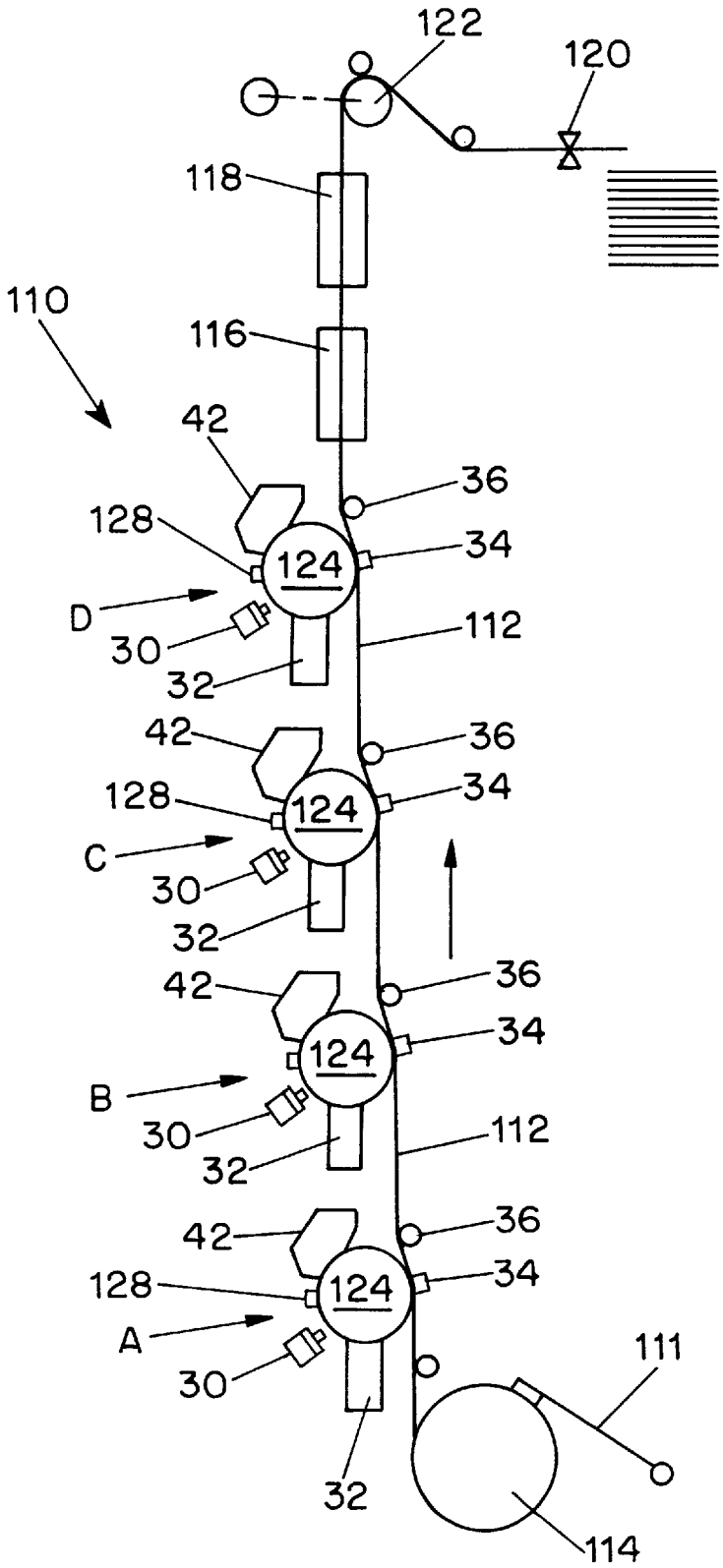
FIG. 12 shows an apparatus according to the current invention, based on electrophotographic printing.

The Chromapress printer 110 schematically shown in FIG. 12 as disclosed in EP-A-0 629 924 shows 4 printing stations A, B, C and D which are arranged to print normally yellow, magenta, cyan and black images respectively. For the test, printing stations A, B and C were supplied with tone having substantially the same chromaticity.

The printing stations ie, image-producing stations A, B, C and D are arranged in a substantially vertical configuration, although it is of course possible to arrange the stations in a horizontal or other configuration. A web of paper 112 unwound from a supply roller 114 is conveyed in an upwards direction past the printing stations in turn. The moving web 112 is in face-to-face contact with the drum surface over a wrapping angle determined by the position of guide rollers 36. After passing the last printing station D, the web of paper 112 passes through an image-fixing station 116, an optional cooling zone 118 and thence to a cutting station 120 to cut the web 112 into sheets. The web 112 is conveyed through the printer by a motor-driven drive roller 122 and tension in the web is generated by the application of a brake 111 acting upon the supply roller 114.

Each printing station comprises a cylindrical drum 124 having a photoconductive outer surface. Circumferentially arranged around the drum 124 there is a main corotron or scorotron charging device 128 capable of uniformly charging the drum surface, for example to a potential of about −600 V, an exposure station 30 which may, for example, be in the form of a scanning laser beam or an LED array, which will image-wise and line-wise expose the photoconductive drum surface causing the charge on the latter to be selectively reduced, for example to a potential of about −250 V, leaving an image-wise distribution of electric charge to remain on the drum surface. Each LED of the LED array may address one specific microdot on the photoconductive drum, which corresponds to one microdot on the final substrate by transferring the toner image from the photoconductive drum to the substrate. Also a scanning laser beam is capable to address individual disjunctive microdots. Adjacent LEDs in the LED array, together with the rotation of the photosensitive drum 124 with respect to the LED array 30 may establish a region of adjacent microdots. By modulating the light intensity of the LEDs 30, the reduced charge per microdot may be larger or smaller. After development, this results in microdots having a low, medium or high amount of toner. The number of microdots in a region having a specific amount of toner, may be controlled by suitable control of the light intensity of the individual LEDs. Since the web 112 passes by all drums 124, the toner images formed on each drum are transferred in superposition to the web or substrate 112. The so-called "latent image" is rendered visible by a developing station or toner station 32 which by means known in the art will bring a developer in contact with the drum surface. The developing station 32 includes a developer drum. According to one embodiment, the developer contains:

(i) toner particles containing a mixture of a resin, a dye or pigment of the appropriate color, coloring power or density and normally a charge-controlling compound giving triboelectric charge to the toner, and (ii) carrier particles charging the toner particles by frictional contact therewith. The carrier particles may be made of a magnetizable material, such as iron or iron oxide.

In a typical construction of a developer station, the developer drum contains magnets carried within a rotating sleeve causing the mixture of toner and magnetizable material to rotate therewith, to contact the surface of the drum 124 in a brush-like manner.

Negatively charged toner particles, triboelectrically charged to a level of, for example 9 $\mu$C/g, are attracted to the photo-exposed areas on the drum surface by the electric field between these areas and the negatively electrically biased developer so that the latent image becomes visible.

After development, the toner image adhering to the drum surface is transferred to the moving web 112 by a transfer corona device 34. The moving web 112 is in face-to-face contact with the drum surface over a wrapping angle of about 15° determined by the position of guide rollers 36. The charge sprayed by the transfer corona device, being on the opposite side of the web to the drum, and having a polarity opposite in sign to that of the charge on the toner particles, attracts the toner particles away from the drum surface and onto the surface of the web 112. The transfer corona device 34 also serves to generate a strong adherent force between the web 112 and the drum surface, causing the latter to be rotated in synchronism with the movement of the web 112 and urging the toner particles into firm contact with the surface of the web 112. Thereafter, the drum surface is pre-charged to a level of, for example −580 V, by a pre-charging corotron or scorotron device (not shown). The pre-charging makes the final charging by the corona 128 easier. Thereby, any residual toner which might still cling to the drum surface may be more easily removed by a cleaning unit 42 known in the art. Final traces of the preceding electrostatic image are erased by the corona 128. After passing the first printing station A, as described above, the web passes successively to printing stations B, C and D, where images developed by other toners are transferred to the web. It is critical that the images produced in successive stations be in register with each other. In order to achieve this, the start of the imaging process at each station has to be critically timed. However, accurate registering of the images is possible only if there is no slip between the web 112 and the drum surface. In normal operation, four toner stations at each side are used, in order to overlay cyan, magenta, yellow and black toner, for reproducing color images. In operation according to the current invention, at least two toner stations have a toner having substantially the same chromaticity. The Chromapress printer may print 1000 A3 size pages (297 mm×420 mm) per hour. The resolution is 600 dpi, such that the size of one microdot is about 42 $\mu$m. To each microdot and per toner station, 64 different energy levels (addressable with six bits) may be applied, in order to vary the amount of toner particles deposited per toner station. Usually, only sixteen levels from these 64 levels are selected in order to achieve density levels which are discernible from each other.

Since the toners had a $d_{v50}$ of 8 $\mu$m, the number N of different types of toner was chosen to be 3.

Figure 9:
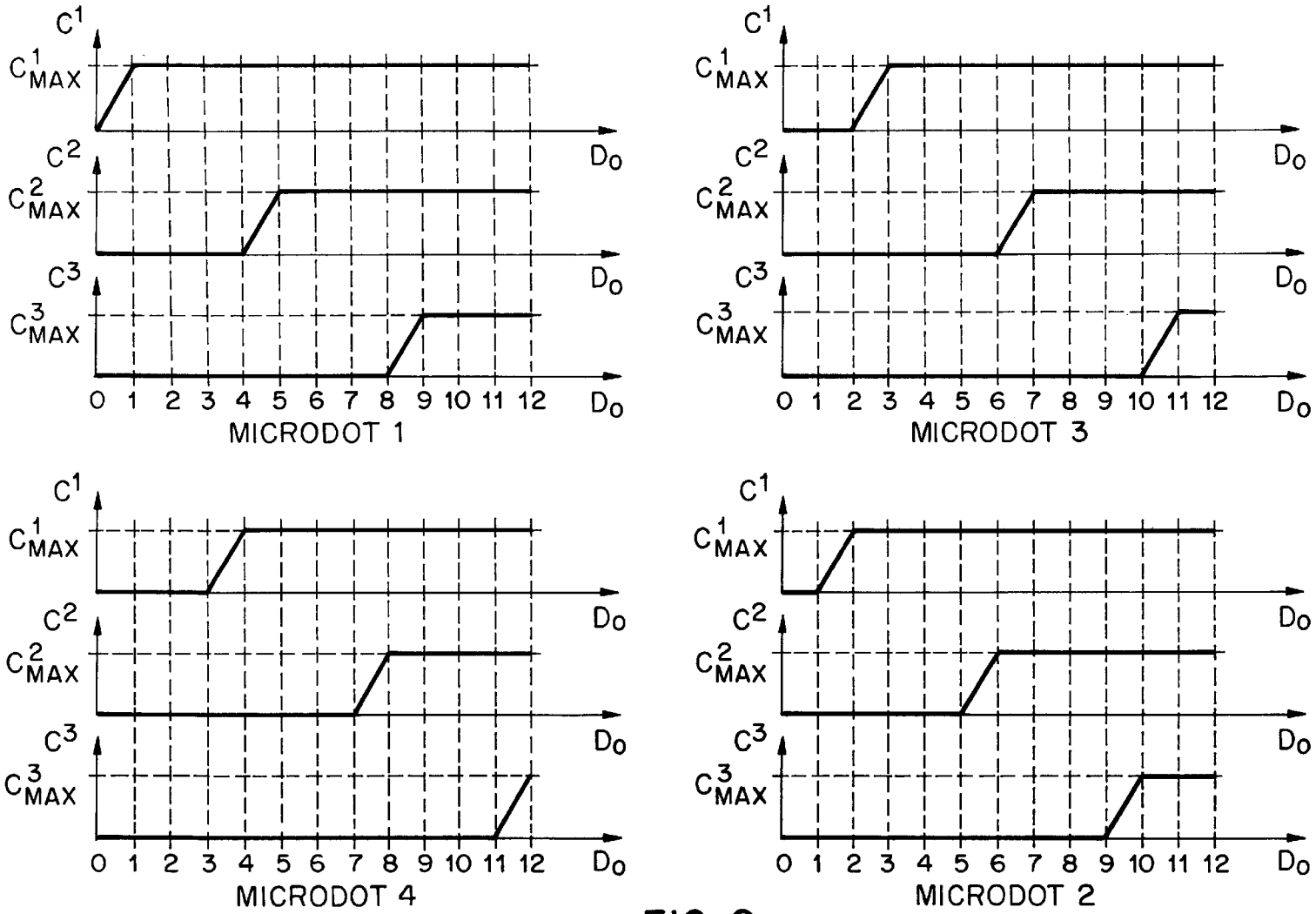
FIG. 9 shows the toner concentration of different microdots in a cell for 3 toners.

In a first printing experiment, the 600 dpi microdots were grouped 2 by 2 in adjacent halftone cells, in order to have a higher grey-scale resolution per toner printing station at a 300 dpi resolution than the 64 levels at 600 dpi. A table was built with three amounts of toners—indicated by $C^1$, $C^2$ and $C^3$ in FIG. 9, where $C^1$ stand for the amount of toner A, $C^2$ for the amount of toner B and $C^3$ for the amount of toner C—and four microdots: microdot 1, microdot 2, microdot 3 and microdot 4. The microdots were geometrically arranged as shown in FIG. 9: microdot 1 top left in the cell, microdot 3 top right in the cell, microdot 4 bottom left and microdot 2 bottom right. As the density $D_0$ increased, the toner concentrations $C^1$, $C^2$ and $C^3$ were varied according to the graphs in FIG. 9. For the lowest density values, the concentration of the first toner for microdot 1 was increased from zero to maximum. In order to achieve higher density levels $D_0$, the concentration of the first toner for microdot 2 increases from zero to maximum. The same happens for microdots 3 and 4 respectively. Once the four microdots got the maximum toner concentration of the first toner, the concentration of the second toner is increased from zero to maximum, first for microdot 1, then 2, 3 and 4 respectively. Once the four microdots of the cell are covered by maximum amounts of toner A and toner B, then the concentration of toner C in increased for microdot 1, 2, 3 and 4 respectively from minimum to maximum concentration in order to achieve a higher density on the substrate.

A wedge consisting of patches of 1 $cm^2$ of following 19 input levels $X_i$ was printed: 0, 42, 84, 126, . . . 714, 756. These input levels correspond with the figures in abscissa $D_0$, multiplied with 63. E.g. 12*63=756. After printing, the reflectance densities $Y_i$ were measured and represented in a graph. The desired overall tone behavior may be obtained by executing a procedure like the one represented below, including the following steps:

expressing the $Y_i$ in the appropriate space (e.g. Opacity, Density or Lightness);

fitting a continuous representation to the inverted couples $Y_i$, $X_i$;

sampling that continuous representation equidistantly at the desired number of input levels.

In this manner, 256 levels equidistant in Opacity were selected out of the 757 input-levels from FIG. 9. A medical image digitized at eight bits and with resolution of 300 dpi was printed.

An advantage of this method is that the opaque reflecting substrate is always covered by a full layer of toner A (first toner with concentration $C^1$), before any toner of toner composition B (second toner) of higher pigmentation is deposited, such that intentional modulation and noise associated with the tone layer B is reduced in amplitude to the difference in opacity of layer A and the combined layers A+B. Similarly, fluctuations due to toner C have an amplitude limited to the difference in opacity of layer A+B and layer A+B+C. A disadvantage is the significant toner consumption: three full layers of toner are deposited to achieve maximum density.

In order to assess the print quality, the "perceived" standard deviation of a substantially constant density was measured. Patches with microdots having maximum toner concentration were produced. The printing was done on paper and the density patches were measured in reflection mode. In a first test, a visual density of 1.45 was produced by making use of one toner. In a second test, the same visual density was obtained by using three types of achromatic toners in overprinting, in a printer according to the current invention. For both the first and second test, the homogeneity of the patches was measured.

The homogeneity of a patch of even densities was expressed with respect to the visibility of density differences, i.e. to the way a human observer would perceive these differences. Therefore, the measured values of density variations (in fact a well known $\sigma_D$) were recalculated to density variations as perceived by a human observer. In practice, a sample of even density patches printed on paper was scanned in the direction of the movement of the receiving substrate with a slit of 2 mm by 27 $\mu$m and a spatial resolution of 10 $\mu$m. The sampling distance was 1 cm and 1024 data points were sampled. The sampling proceeded in reflection mode and the reflectances where measured.

The obtained scan of the reflectances was converted to a "perceived" image by means of a perception model. This conversion comprises the following steps:

(i) applying visual filtering, describing the spatial frequency characteristics of the "early" eye, i.e. only taking in account the receiving characteristics of the eye. The filter used, was the one as described in detail by J. Sullivan et al. in IEEE Transactions on Systems, Man and Cybernetics, vol. 21, n° 1 p. 33 to 38, 1991. Contrary to the filter described in said reference, the filter was not levelled off to a value of one for frequencies lower than the frequency of maximum sensitivity of said early eye. This means that in measurement, a band-pass filter was used, instead of a low-pass filter in the reference cited above. The viewing distance was 25 cm.

(ii) transforming the reflectances (R), that have been transformed in step (i) by the filtering, to visual densities ($D_{vis}$), by following formulae:

$D_{vis}=2.55\times(1-R^{1/3})$ when the reflectance (R) is higher than or equal to 0.01, and $D_{vis}=2.00$ when the reflectance (R) is lower than 0.01, while the eye can differentiate reflectances below 0.01.

In the thus obtained "perceived" image the standard deviation of the density fluctuation ($\sigma_D$) was calculated.

A value for the parameter $\sigma_D$ smaller than 0.045 means acceptable image quality, in terms of homogeneity of even density patterns, a value smaller than 0.030 means excellent quality, a value of 0.025 to 0.020 is typical for offset high-quality. The results of this analysis was 0.030 for the first test, using one single toner type and the result was 0.020 for the second test, using three toner types having substantially the same chromaticity. From these results it is clear that the noise level is substantially lower if more toner types are used.

The same tests were done for patches which were obtained by multilevel halftoning techniques, in order to achieve visual densities between 0.6 and 1.2. In all these cases, the results when using several toner types were better than 0.025, while the results when using one single toner type were above 0.030.

In a second printing experiment, wherein the toner consumption could be reduced by approximately 33%, while keeping the desired noise reduction effect and the stabilization of highlight rendition described above to a large extent, is based on the scheme of the second experiment with the Agfa Chromapress system.

Three of the five 600 dpi six bit toner printing stations of the recto side of an Agfa Chromapress were filled with three two-component developers, where the carbon pigmentation was the same as in the first experiment, leading to the same measured reflectance densities when the logical full density exposure for each of the toner printing stations was selected.

Figure 10:
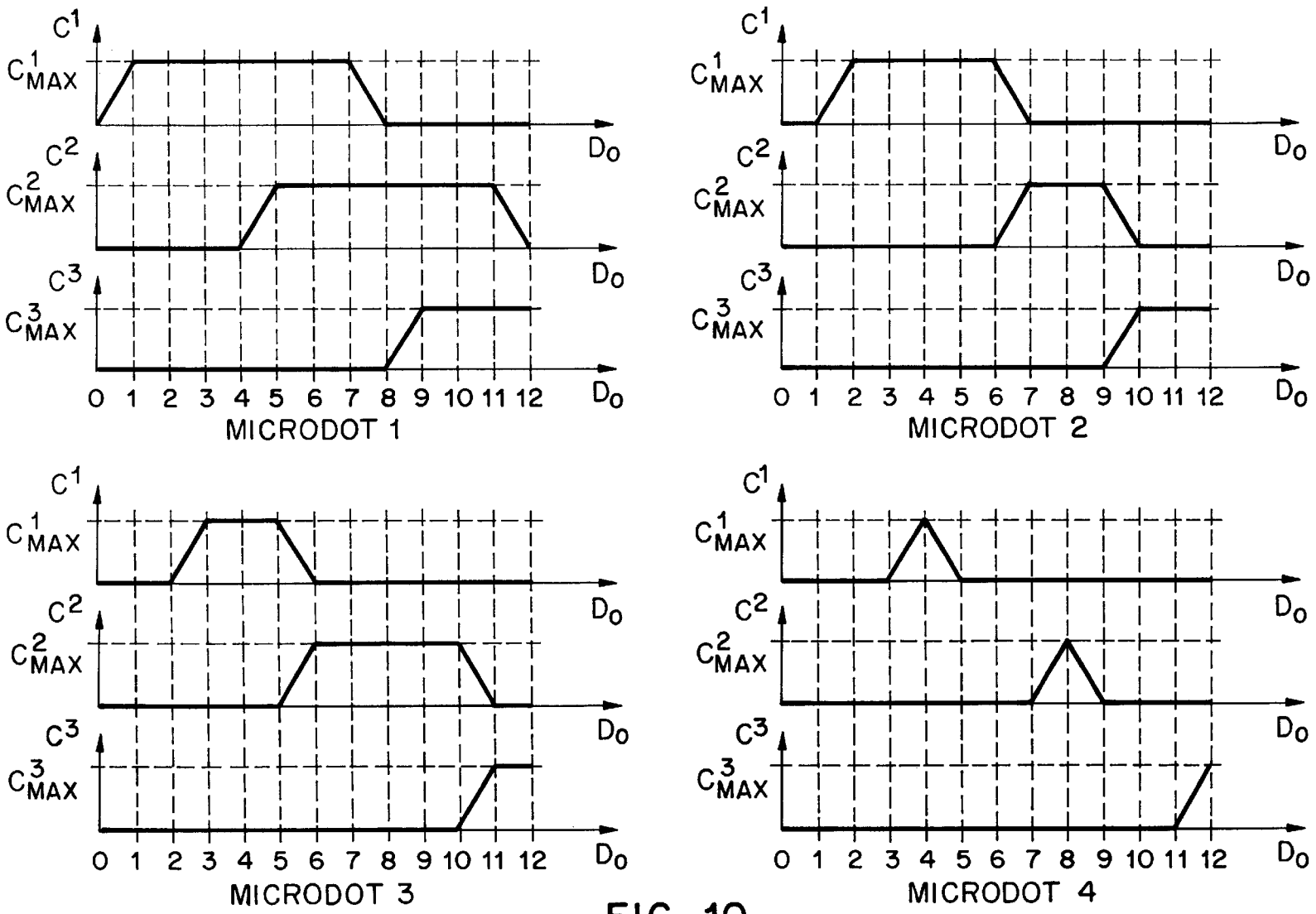
FIG. 10 shows the same variables as FIG. 9 in another embodiment of the present invention.

Again, the 600 dpi microdots were grouped in halftone cells in a 2 by 2 fashion, in order to get a higher grey-scale resolution per toner printing station at a 300 dpi resolution than the 64 levels at 600 dpi. A concentration scheme was built with three toners and four microdots, using 63 entry levels, per microdot and per printing station, as depicted in FIG. 10. The microdots were numbered according to the geometry in FIG. 10. The numbers in abscissa (0 to 12) may be multiplied by 63 in order to get input-levels from 0 to 756. Note that the microdot arrangement in the cell is chosen such that toners A ($C^1$) and C ($C^3$) form horizontal lines when two out of the four pixels are on, while toner B ($C^2$) forms vertical lines when two out of the four microdots are on. This is advantageous to minimise the sensitivity to wrong registration and banding, induced by vibration. This may be understood by the assumption that intersecting perpendicular lines do not change their mutual overlap when one set of lines is shifted with respect to the other.

A wedge consisting of patches of 1 $cm^2$ of the next 19 input levels $X_i$ was printed: 0, 42, 84, 126, . . . 714, 756 and the measured reflectance densities $Y_i$ were represented in a graph. Using the method as set out under the first example, 256 equidistant levels with respect to opacity were selected out of the 757 from FIG. 10. Again a medical image was printed, the image being represented by 256 density levels and having a resolution of 300 dpi. Again, noise levels were substantially reduced.

Having described in detail preferred embodiments of the current invention, it will now be apparent to those skilled in the art that numerous modifications can be made therein without departing from the scope of the invention as defined in the following claims.

What is claimed is:

1. An apparatus for reproducing a continuous tone image by image-wise application of toner particles to a substrate comprising:

means for partitioning a surface of said substrate into a plurality of disjunctive microdots; and, means for applying to at least one microdot at least two types of toner, having substantially the same chromaticity.

2. The apparatus according to claim 1, further comprising:

means for establishing a region of adjacent microdots, comprising said at least one microdot;

means for applying to at least one microdot within said region a high amount of one of said at least two types of toner;

means for applying to at least one other microdot within said region a low amount of said one toner; and, means for applying to at least one other microdot within said region a medium amount of said one toner.

3. The apparatus according to claim 2, comprising means for supplying a minority of microdots within said region with a medium amount of toner, for each of said at least two types of toner.

4. The apparatus according to claim 1, comprising means for supplying a microdot with a plurality of toner types having substantially the same chromaticity, and for supplying said microdot with a high amount of at least one toner type having said chromaticity.

5. The apparatus according to claim 2, comprising means for supplying at least one microdot within at least one region with a plurality of toner types, having substantially the same chromaticity, and means for supplying said microdot completely with a high amount of at least one toner type.

6. The apparatus according to claim 1, comprising N toner stations for printing microdots, each toner station for applying one type of toner particles having substantially the same chromaticity, said toner particles of one type having a largest average volume diameter $d_{v50}$ and wherein said number N fulfils the relation $N \geqq 0.3 \times d_{v50}$ and wherein N is determined by adding 0.5 to $0.3 \times d_{v50}$ and rounding to the next lower integer.

7. The apparatus according to claim 1, comprising N toner stations for printing microdots, each toner station for applying one type of toner particles, having substantially the same chromaticity, said toner particles of one type having a largest average volume diameter $d_{v50}$, and wherein said number N fulfils the relation $N \geqq 0.4 \times d_{v50}$ and wherein N is determined by adding 0.5 to $0.4 \times d_{v50}$ and rounding to the next lower integer.

8. The apparatus according to claim 1, comprising means for generating a finished image having maximally 2 mg of toner per $cm^2$.

9. The apparatus according to claim 1, wherein said types of toner particles differ in degree of coloring power, toner particles $T_1$ having the lowest degree of coloring power, toner particles $T_{max}$ having the highest coloring power.

10. The apparatus according to claim 1, wherein said types of toner particles have a different volume average diameter $d_{v50}$.

11. The apparatus according to claim 9, wherein said coloring power of toner particles ($T_1$) is such that depositing an amount of $T_1$ gives between 10 and 50% of the density given by depositing an equal amount of toner particles ($T_{max}$).

12. The apparatus according to claim 9, wherein said toner particles $T_1$ have an average volume diameter $d_{v50}$ between 5 and 20% lower than said toner particles $T_{max}$.

13. The apparatus according to claim 1, comprising means for printing on a transparent final substrate and wherein at least one of said types of toner particles comprises one or more ingredients that together or in cooperation with ingredients comprised in said final substrate are capable of forming a light absorbing substance and said toner particles optionally comprise a light absorbing pigment or dye.

14. The apparatus according to claim 1, wherein said toner particles are dry toner particles.

15. The apparatus according to claim 1, wherein said apparatus is an electrographic apparatus.

16. The apparatus according to claim 2, wherein said region is a multilevel halftone cell, comprising disjunctive sets of adjacent microdots.

17. The apparatus according to claim 1, wherein said continuous tone image is a medical image.

18. The apparatus according to claim 17, comprising means for printing on a transparent support, wherein said support is a blue polyester support.

* * * * *